United States Patent [19]

Docx

[11] 3,952,408

[45] Apr. 27, 1976

[54] METHOD OF ASSEMBLING A RESISTANCE FURNACE

[76] Inventor: Albert George Docx, 70 Ellesmere Road, Altrincham, Cheshire, England

[22] Filed: July 30, 1974

[21] Appl. No.: 493,642

Related U.S. Application Data

[63] Continuation-in-part of Ser. No. 286,336, Sept. 5, 1972, abandoned, which is a continuation-in-part of Ser. No. 123,807, March 12, 1971, abandoned.

[30] Foreign Application Priority Data

Mar. 26, 1970 United Kingdom ..... 14789/70
May 2, 1970 United Kingdom ..... 21219/70

[52] U.S. Cl. ..... 29/611; 156/173; 219/544

[51] Int. Cl.[2] ..... H05B 3/18

[58] Field of Search ..... 156/172, 173, 182, 246, 156/500, 515, 256; 219/390, 464, 552, 549, 544; 13/20, 22, 75, 31; 264/30; 338/303, 781, 253, 252, 262, 264, 269, 570; 29/611, 670; 427/101

[56] References Cited

UNITED STATES PATENTS

| | | | |
|---|---|---|---|
| 1,534,592 | 4/1925 | Houck | 219/390 |
| 1,767,586 | 6/1930 | Hudson | 264/59 |
| 2,572,695 | 10/1951 | Briscoe et al. | 219/545 |
| 2,809,822 | 10/1957 | Gier, Jr. | 13/22 |
| 2,963,529 | 12/1960 | Schmidt | 13/22 |
| 2,966,537 | 12/1960 | Witucki et al. | 13/22 |
| 3,086,101 | 4/1963 | Scofield | 219/37 |
| 3,128,326 | 4/1964 | Hintenberger | 13/31 |
| 3,275,497 | 9/1966 | Weiss et al. | 264/59 |
| 3,441,652 | 4/1969 | Eicker | 13/20 |
| 3,479,490 | 11/1969 | Stark | 219/544 |
| 3,496,336 | 2/1970 | Hingorany et al. | 219/544 |
| 3,500,444 | 3/1970 | Hesse et al. | 219/464 |
| 3,523,363 | 8/1970 | Kuwayama et al. | 29/611 |
| 3,612,828 | 10/1971 | Siegia | 219/464 |

*Primary Examiner*—William A. Powell
*Assistant Examiner*—Michael W. Ball
*Attorney, Agent, or Firm*—Holman & Stern

[57] ABSTRACT

In furnaces and particularly dental furnaces it is necessary to switch the furnaces, on some considerable time before required and to keep them hot all day. The present invention enables a furnace to be constructed which can be raised to pull heat in a few minutes and be cooled off just as quickly, and comprises a muffle or muffle section having a heating element carried by a support of ceramic fibrous material and constructed by novel methods.

2 Claims, 6 Drawing Figures

METHOD OF ASSEMBLING A RESISTANCE FURNACE

RELATED APPLICATIONS

This application is a continuation-in-part of Ser. No. 286,336 filed Sept. 5, 1972, and now abandoned, which in turn is a continuation-in-part of application Ser. No. 123,807 filed Mar. 12, 1971, and now abandoned.

BACKGROUND OF THE INVENTION

This invention relates to methods of construction of muffles and furnaces of the muffle type and, more particularly though not exclusively, to dental muffle furnaces.

PRIOR ART

A disadvantage of previously proposed muffle furnaces is that the heating element of the muffle is wound on a solid ceramic support which is liable to fracture if heated at a fast rate. Consequently, a disadvantage of such furnaces is that they require to be brought up to the desired temperature slowly, thereby incurring a considerable wastage of time before the furnace can be used.

OBJECTS AND SUMMARY OF THE INVENTION

An object of the present invention is to obviate or mitigate the above disadvantages.

According to the present invention, there is provided a method of producing a muffle, or a muffle section comprising the steps of temporarily supporting an electric heating element in a desired position, and applying ceramic fibers to the supported electric heating element so as to form a support for the electric heating element.

Preferably, the support of ceramic fibrous material is formed in situ on the electric heating element.

The ceramic fibers may be in the form of a ceramic fiber paper or in the form of a slurry.

Embodiments of the present invention will now be described, by way of example, with reference to the accompanying drawings, in which:

DETAILED DESCRIPTION OF THE DRAWINGS

Figure 3:
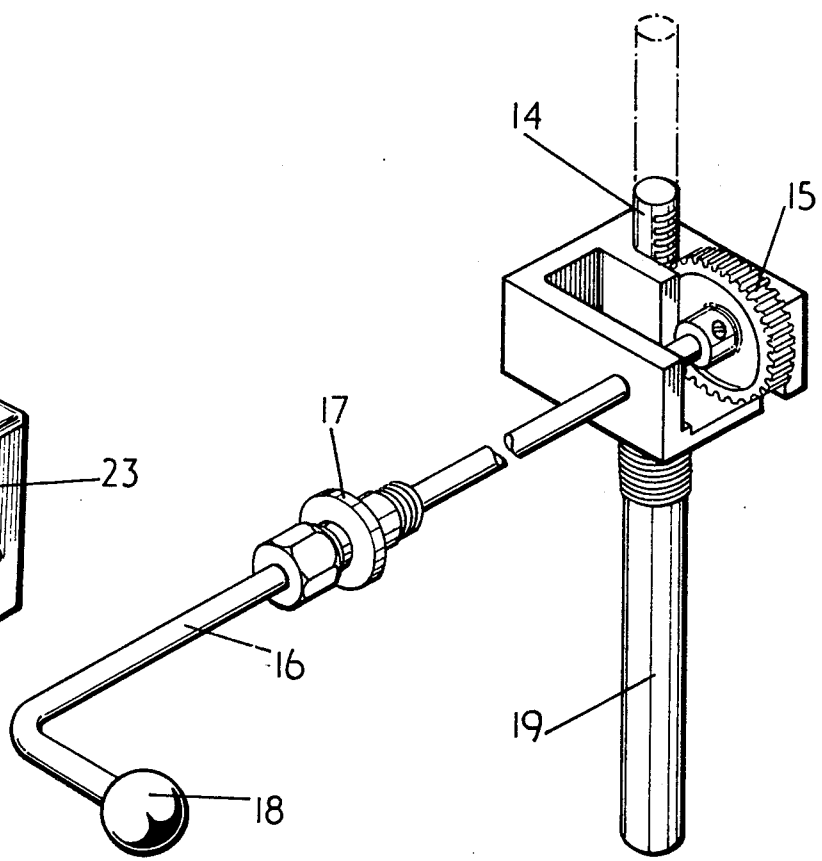
FIG. 3 is a perspective view of the mechanism for raising and lowering the workpiece support shown in FIG. 2.

The furnace which is a dental muffle furnace comprises a vertical cylindrical casing 1, sealed at the top and bottom by end plates 2 and 3 and heat resistant O-rings 4, with tie rods 5 being employed to fasten the end plates 2 and 3 to the casing 1 to provide a gastight seal. Adjacent the top of the casing 1, there is provided a muffle comprising a vertical hollow cylindrical support 6 formed by a vacuum forming operation from ceramic fibers sold under the trademark "TRITON KAOWOOL" produced by Morganite Ceramic Fibres Limited, Neston, Wirral, Cheshire, England.

TRITON KAOWOOL is an aluminosilicate fiber which can be used continuously in temperatures up to 2300°F. (1260°C.) and even higher in some applications, with very little physical change. It melts at 1760°C. Its strength, flexibility, resilience and resistance to vibration stem from the long, individual fibers, up to 10 inches (25 centimeters) and their interlacing. They also make possible a completely inorganic blanket form free from additives. Chemically, it is extremely pure (45% alumina, 52% silica) and physically its fibers are long and of very small diameter (2.8 microns, average). Hence, it has exceptional heat insulating and resisting characteristics.

TRITON KAOWOOL is available as bulk fiber (wool blanket), strip, paper, castable, tamping and ramming mix, die cut shapes, mesh, spray mix, vacuum-formed shapes, surface coating, and wet felt. The tamping and ramming mix is composed of TRITON KAOWOOL and an inorganic binder, with average finished densities being: tamping mix: 25lb/cu.ft. (400 Kg./m$^3$); ramming mix: 38lb./cu.ft (608 Kg./M$^3$), in 5 gallon (22.7 liter) steel drums.

The hollow support 6 mounts an electrical heating wire 7 also forming part of the muffle, with the wire being partially embedded in the internal surface of the hollow support by vacuum forming the ceramic fiber around the wire 7 held in situ on a former (not shown) during this process. The inside of the muffle forms a heating zone 8 with the electrical heating wire 7 radiating heat directly into the heating zone 8.

Around the hollow support 6 there is wound paper 9 made from the same ceramic fibers as the support to strengthen the muffle and to increase its diameter sufficiently to enable it to be located accurately within a cylindrical jacket 10 disposed within the casing 1 and formed by producing a mix of the same ceramic fibers as the support 6 and ramming the mix into the casing 1 around a former (not shown). A space between the top of the muffle and the top of the casing 1 is filled with a formed plug 11 of the same ceramic fibers. Below the muffle, there is a chamber 12 defined by the jacket 10 and connected with the heating zone 8. The chamber 12 accommodates a vertically movable workpiece support in the form of a table 13 mounted to be movable into and out of the heating zone 8. A rack 14 attached to the table 13 is in mesh with a pinion 15 rotatable by a shaft 16 passing through a gland 17 to the outside of the casing 1. Rotation of the shaft 16 by means of a hand lever 18 causes the table 13 to be moved into or out of the heating zone 8. The rack 14 is housed in a passage tube 19 sealed at the bottom formed in the jacket and hermetically sealed by an outer cover 21 connecting the chamber with the outside of the casing to enable a workpiece to be laid into or removed from the table 13.

Figure 1:
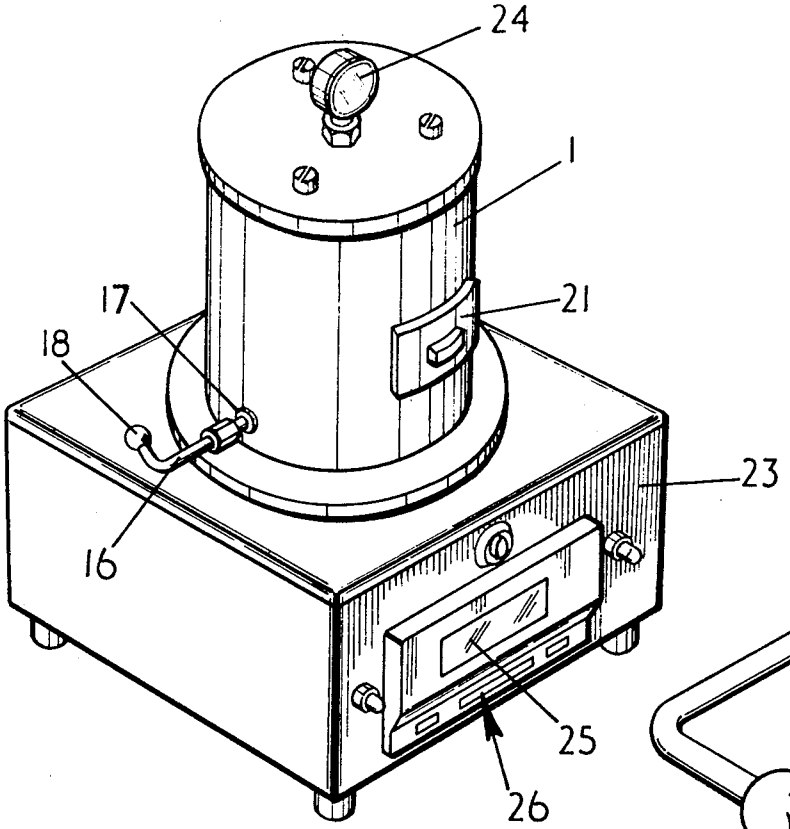
FIG. 1 is a perspective view of a furnace.
Figure 2:
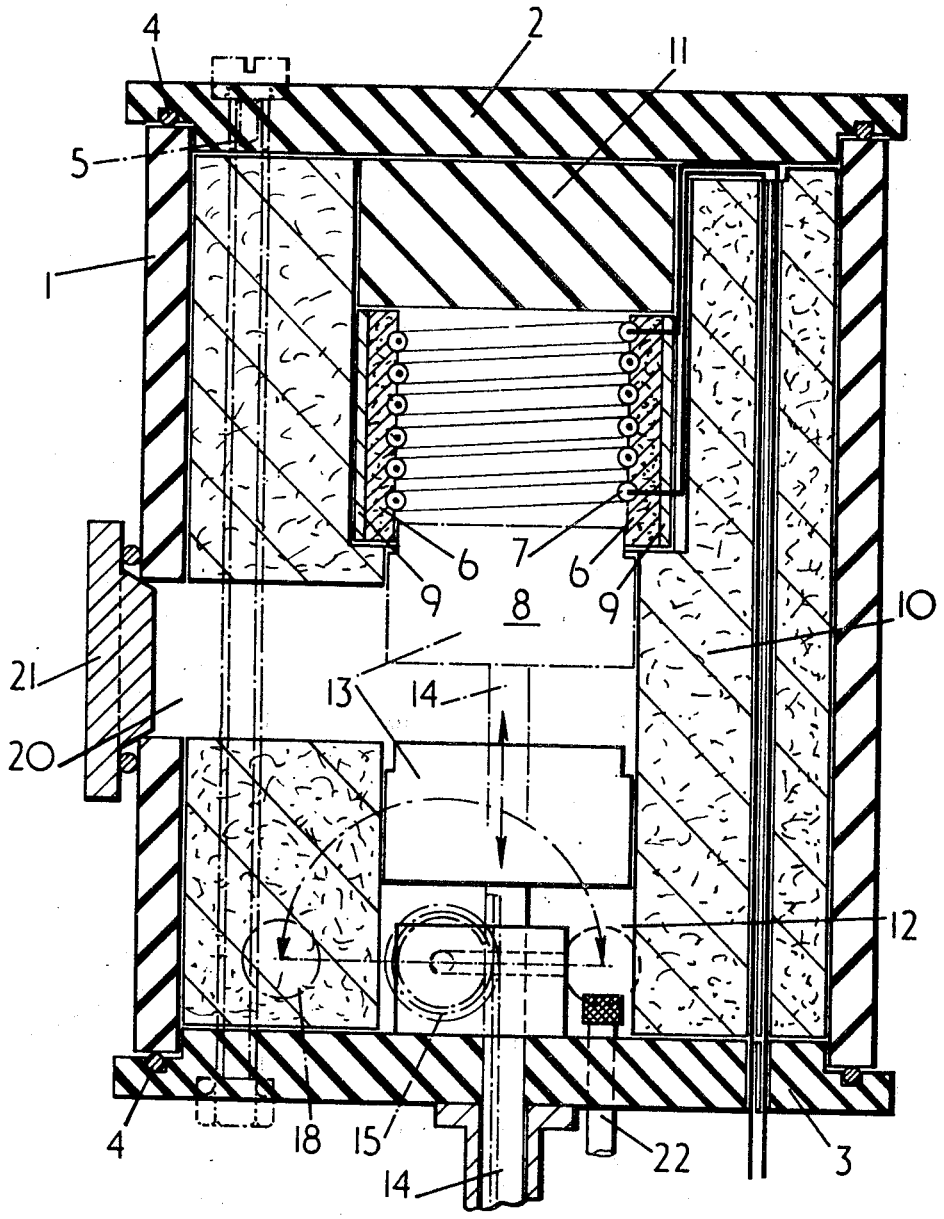
FIG. 2 is a diagrammatic sectional view in elevation of part of the furnace shown in FIG. 1.

A pipe 22 passes into the chamber 12 through a base 23 (see FIG. 1) and serves to enable both the chamber 12 and the heating zone 8 to be evacuated. A pressure gauge 24 is provided (FIG. 1) for monitoring the pressure in the chamber 12 and heating zone 8. A thermocouple (not shown) is disposed within the heating zone 8 and serves to enable the temperature therein to be monitored.

The furnace is mounted on the base 23 containing control equipment including a temperature indicator 25 connected with the thermocouple, a controller indicated generally at 26 for the temperature and rate of rise thereof in the heating zone, and a timer 27.

In use, a workpiece to be fired, e.g., an unfired ceramic false tooth, is laid on the table 13 which is raised to bring the workpiece into the muffle. The passage 20 is then sealed, the chamber 12 and heating zone 8 evacuated and the timer 27 is set. When the firing process is completed, the table 13 is lowered by hand, air is admitted to the chamber 12, the passage 20 is opened by removal of the cover 21 and the fired workpiece is removed.

If desired, the support, forming part of the muffle, may be produced by filling the coiled electrical heating wire with a slurry of cement incorporating the aforementioned ceramic fibers and ceramic fiber strip wound on to a former, with the coils being spaced by ceramic fiber paper. The assembly is then kiln dried and a ceramic fiber paper tube wound around the outside of the wire.

A convenient way of vacuum molding the muffle is to provide a cylindrical, brass wire gauze former having a helical corrugation formed therein and to wind the electrical heating wire in the bottom of the corrugation to obtain equal spacing between the turns of the coil. The ends of the wire are secured in any desired manner to secure the coil in position and the assembly of former and wire dipped into a slurry of the ceramic fibers at room temperature. when a reduced pressure is applied to the inside of the former, fibers are built up evenly around the former with the electrical heating wire in situ to produce the support with the wire partially embedded in the internal surface of the support.

The support is then processed to strengthen it and the former removed.

If desired, spacers formed of the ceramic fibers may be used to provide equal spacing between the turns of the electrical heating wire instead of providing a helical corrugation of the gauze former.

For many industrial applications, square or rectangular section muffles may be required. Such muffles can conveniently be formed by a plurality of flat sections, e.g., three side sections and one roof section, which are subsequently assembled to produce the completed muffle.

Each section can be produced by attaching the electrical heating wire in the desired configuration to one side of a flat brass wire gauze former. The ceramic fibers are then deposited on the former by application of a reduced pressure on the reverse side of the former so as to produce a flat section with the electrical heating wire partially embedded in that face thereof which is destined to become the internal or hot face of the section in the completed muffle.

Each section can be produced by attaching the electrical heating wire in the desired configuration to one side of a flat brass wire gauze former. The ceramic fibers are then deposited on the former by application of a reduced pressure on the reverse side of the former so as to produce a flat section with the electrical heating wire partially embedded in that face thereof which is destined to become the internal or hot face of the section in the completed muffle.

Four of the sections produced as described above are assembled to produce the square or rectangular section muffle and the electrical heating wires in adjacent sections are electrically connected together at locations remote from the hot face of the muffle.

In a further method of producing a muffle according to the present invention, a coil of electrical heating wire is held in situ in the desired position on a cylindrical or flat former. The ceramic fibers in suspension in a hydraulic setting agent are then sprayed into and onto the windings completely encasing all areas of the coil and built up to just beyond the outer surface of the coil. The assembly is then dried and the element "fixed." Additional layers of ceramic fibers may then be added to any desired thickness.

Due to the construction of the support for the heating element, a furnace according to the present invention can be heated to the desired temperature and cooled quickly without risk of the support being fractured.

The furnace can also be switched off in between firings since it can be heated up again quickly, thus enabling a considerable savings in costs over conventional furnaces which must be kept idling all day.

Figure 4:
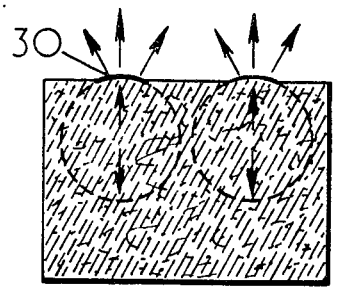
FIG. 4 is a fragmentary sectional view of a muffle in which the heating element is mainly embedded in the ceramic fiber.

The thermal capacity of support is low. Furthermore, hermetic sealing of the furnace is improved due to the provision of the rotary shaft for operating the table, as a rotary shaft is easier to seal than longitudinally slidable shafts used previously in such furnaces.

Where particularly elevated temperatures (say, above 1150°C) are used, it is found that if a coil heating element is totally embedded in a vacuum formed ceramic fiber block or tube that only a small proportion of the surface of the element exposed at the hot face as shown at 30 in FIG. 4, the resultant inequalities of radiation may encourage the formation of hot spots. Such hot spots usually develop approximately diametrically opposite to the small radiation area 30 and a premature burn out of the element can result.

To combat this problem, constructions of muffles and muffle blocks have been developed so that a spiral element is hollow and free from ceramic fiber and also a small crescent-shaped void is left at the back of the element. This void causes the ceramic fiber material to form a reflective barrier which reflects the heat through the hollow coil and out through the exposed element surface, thus balancing heat irregularities of the heating element.

Figure 5:
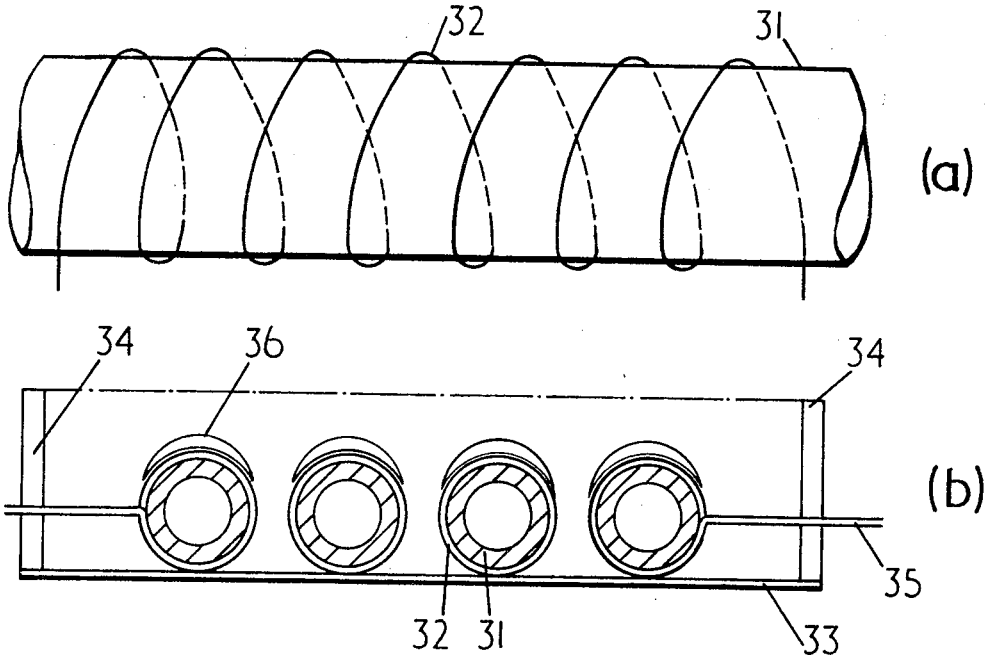
FIG. 5 is a series of schematic diagrams showing the step-by-step construction according to a method of the invention.
Figure 5:
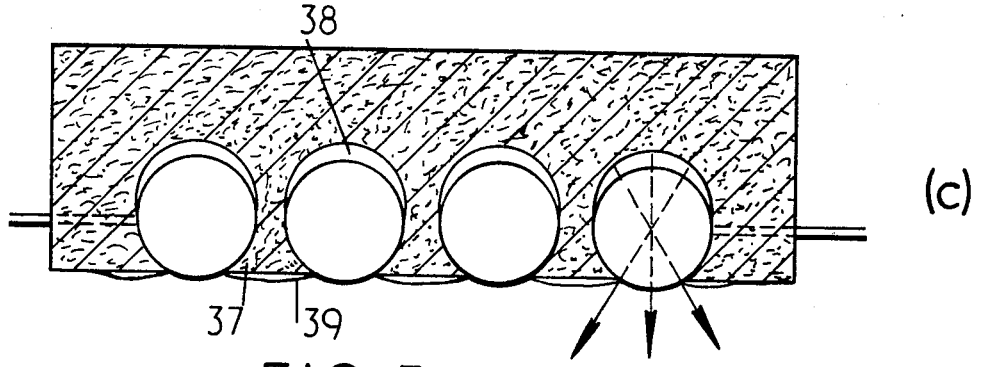

A first method of constructing such a muffle is shown in FIG. 5. A thin-walled plastic tube 31 is threaded through the center of a prepared spiral element 32 (as shown in FIG. 5*a*), taking care that it fills the entire length of the spiral. The plastic tube is of material which will burn out without leaving a residue. The tube and element arrangement are wound around a cylindrical wire mesh former 33 having a limit ring stop 34 at each end (see FIG. 5*b*). The element ends 35 are secured and equal spacing is arranged between the turns of the spiral element. A strip of dental casting wax 36 of crescent section is secured to the back of the spiral element following its contour and length.

The dental wax is such that it will burn out when the element is heated to an elevated temperature and this will provide a desired free-way space at the back of the element.

The assembly of element and former is then dipped into a slurry of ceramic fibers at room temperature and a reduced pressure is applied to the inside of the former 33, thus building up fibers evenly around the element and former and filling the interstitial spaces between the turns of coil, as shown at 37 in FIG. 5*c*. The thickness of the fiber build-up beyond the coil diameter is conveniently one-fourth to one-half inches. The assembly is then dried to strengthen it and the former 33 is removed.

The muffle is then burned out at about 800°C so that both the plastic tube 31 and the dental wax 36 are consumed leaving a hollow spiral with a crescent-shaped void 38. The surface of the interstitial portions 37 are coated with a cement layer 39, with the cement being made of chopped ceramic fibers and a liquid rigidizer which is used to increase hardness and erosion resistance of the ceramic fibers. The muffle is then ready for installation in the furnace.

A wide variety of sizes and shapes of muffles are possible. Flat muffle sections may be produced by the above described method except that the wire is held on a flat mesh for the vacuum forming process.

Figure 6:
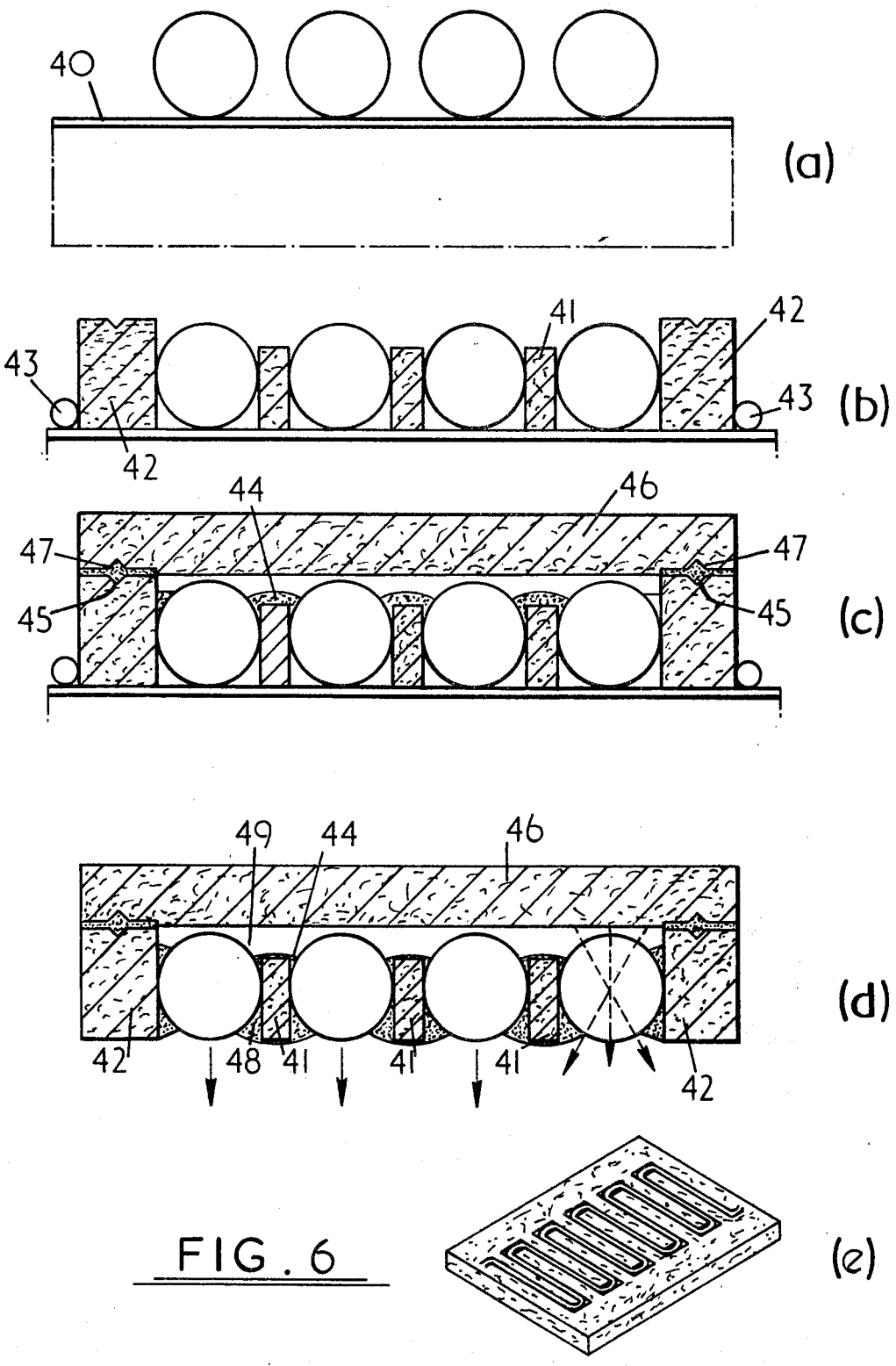
FIG. 6 is a series of schematic diagrams showing the step-by-step construction according to another method of the invention.

In a further method of making a muffle, reference is made to FIG. 6, which shows the various steps involved. As shown at FIG. 6*a*, a coil element is wound around a cylindrical former 40, with the former having been previously silicone coated. A ceramic fiber paper strip or ceramic fiber cord 41, slightly less high than the diameter of the spiral element, is interposed between each turn of the coil (see FIG. 6*b*). End pads 42 made from a vacuum formed ceramic fiber tube cut to size and having a similar inside diameter to the former 40 are placed on the ends and sealed together to give the arrangement shown. Rubber O-rings 43 hold the assembly in place.

A cement made from chopped ceramic fibers and liquid rigidizer is then painted on to the top of the paper spacer and allowed to permeate a little way into the coil. This forms a mushroom heat as shown at 44 in FIG. 6*c*. This helps to lock the coil in place.

The end pads 42 are provided with a groove 45, either before or after fitting to the former 40, and the groove is filled with cement. A cylindrical tube 46 having similar grooves 47 which are filled with cement, is passed over the assembly to occupy the position shown. When the cement is set, a mechanical retention is formed at the key areas preventing movement apart of the coil during the expansion which occurs at high temperature.

The whole assembly is then dried for about 1 hour at about 100°C and the former 40 is then removed. A coat of cement is then added to the spacer at the hot surface as shown at 48 in FIG. 6*d*, with the cement flowing over into the element adjacent the spacer so as to form another mushroom head which blocks the turns of the coil from going out from the assembly. It will be seen that the combination of the end pads 42, the spacer 41 and the cememt mushrooms 44 and 48 accurately locate the coil while providing the minimum of contact between the coil and its support. Also, a desired gap 49 at the back of the coil is provided. This is achieved by having end pads 42 about 2 mm higher than the diameter of the spiral element so that when the tube 46 is in place the free radiation gap 49 remains.

Flat sections of muffle are produced as described above except that a serpentine configuration of the element is laid on a flat surface and spacers and cement interposed as described.

FIG. 6*e* shows a flat muffle section with the heating element arranged in a serpentine configuration.

A suitable slurry is described in U.S. Pat. No. 3,500,444, issued Mar. 10, 1970, as, in percent by weight, 12% (0.42 lb.) binder of Baymal solids, Du- Pont's colloidal alumina product described in U.S. Pat. No. 2,915,475; 4% (0.14 lb.) papermakers alum (aluminum sulfate) coagulant; and 84% inorganic refractory fiber "CERAFIBER", Johns-Manville Corp.'s refractory fiber of substantially equal parts of alumina and silica, dispersed in 100 gallons of water.

Alternative slurry compositions may be used.

The liquid ridigizer is a liquid binder and preferably contains an inorganic colloidial compound such as colloidial alumina. An example of a preferred liquidizer is "TRITON HARDNER" sold by Morganite Ceramic Fibres Limited, and comprising a high purity water based colloidial silical solution containing traces of sodium silicate and chloride ions. Another example of a preferred liquid rigidizer is "FIBREFRAX RIGIDISER" sold by Carborundum Company.

This invention is not to be confined to any strict conformity to the showings in the drawings, but changes or modifications may be made therein so long as such changes or modifications make no material departure from the spirit and scope of the attendant claims.

What is claimed is:

1. A method of producing a muffle and muffle section in which an electric heating element is temporarily supported in a desired position and ceramic fibers are applied to the supported electrical heating element to form a support for the electric heating element, comprising the steps of:

a. winding a prepared spiral heating element around a former with a ceramic fiber spacer between each turn of the coil so formed, b. placing ceramic fiber end pads at the ends of the former so as to grip the coil and spacers lightly together, c. applying cement formed of chopped ceramic fibers and a liquid rigidizer to the exposed top of the spacer allowing it to permeate slightly into the coil to lock the coil and spacer together, d. passing a tube of ceramic fiber over the coil and spacer assembly and cementing the tube to the end pads, e. drying the assembly so formed, f. removing the former, and g. applying cement to the revealed surface of the spacer allowing the cement to permeate slightly into the coil to further lock the coil and spacer together.

2. A method of producing a flat muffle and muffle section in which an electric heating element is temporarily supported in a desired position and ceramic fibers are applied to the supported heating element to form a support for the heating element, comprising the steps of:

a. laying out a spiral heating element on a flat former in a serpentine configuration with a ceramic fiber spacer between adjacent portions of the heating element, b. placing ceramic fiber end pads at the ends of the former so as to grip the heating element and spacers lightly together, c. applying cement formed of chopped ceramic fibers and a liquid rigidizer to the exposed top of the spacer allowing it to permeate slightly into the heating element and spacer together, d. placing a flat sheet of ceramic fiber over the heating element and spacer assembly and cementing it to the end pads, e. drying the assembly so formed,
f. removing the flat former, and
g. applying cement to the revealed surface of the heating element and spacer assembly allowing it to permeate slightly into the heating element to further lock the heating element and spacer together.

* * * * *